United States Patent [19]

Folkins

[11] Patent Number: 4,643,561

[45] Date of Patent: Feb. 17, 1987

[54] CONTROL SYSTEM FOR AN ELECTROPHOTOGRAPHIC PRINTING MACHINE

[75] Inventor: Jeffrey J. Folkins, Rochester, N.Y.

[73] Assignee: Xerox Corporation, Stamford, Conn.

[21] Appl. No.: 729,706

[22] Filed: May 2, 1985

[51] Int. Cl.[4] ..... G03G 15/08

[52] U.S. Cl. ..... 355/14 D; 355/3 DD; 355/3 R; 355/14 R

[58] Field of Search ..... 355/3 DD, 14 D, 3 R, 355/14 R, 3 CH; 118/644, 653, 656, 657, 658; 430/120; 29/132

[56] References Cited

U.S. PATENT DOCUMENTS 4,194,828 5/1980 Holz et al. ..... 355/3 DD 4,505,573 3/1985 Brewington et al. ..... 355/3 DD

*Primary Examiner*—A. C. Prescott

*Attorney, Agent, or Firm*—H. Fleischer; J. E. Beck; R. Zibelli

[57] ABSTRACT

An apparatus which measures the electrical potential of the photoconductive surface. A transport advances material closely adjacent to the photoconductive surface. An electrical bias of a selected magnitude and polarity is applied to the transport. The electrical biasing current is sensed and a signal indicative thereof is transmitted. A charger electrically charges the material being moved to the surface by the transport. The charger is electrically biased to a selected magnitude and polarity. The charger electrical biasing current is sensed and a signal indicative thereof transmitted. The signal indicative of the transport electrical biasing current is summed with the signal indicative of the charger electrical biasing current to generate a signal indicative of the electrical potential on the surface. This signal may be used to control the various processing stations within the electrophotographic printing machine.

14 Claims, 3 Drawing Figures

CONTROL SYSTEM FOR AN ELECTROPHOTOGRAPHIC PRINTING MACHINE

This invention relates generally to an electrophotographic printing machine, and more particularly concerns an apparatus which measures the electrical potential of the photoconductive surface and generates a control signal corresponding thereto.

In general, the process of electrophotographic printing includes charging a photoconductive member to a substantially uniform potential to sensitize the surface thereof. The charged portion of the photoconductive surface is exposed to a light image of an original document being reproduced. Alternatively, a modulated light beam, i.e. a laser beam, may be utilized to discharge selected portions of the charged photoconductive surface to record the desired information thereon. In this way an electrostatic latent image is recorded on the photoconductive surface which corresponds to the information desired to be reproduced. After recording the electrostatic latent image on the photoconductive member, the latent image is developed by bringing developer material into contact therewith. Generally, the developer material comprises toner particles adhering triboelectrically to carrier granules. The toner particles are attracted from the carrier granules to form a toner powder image on the photoconductive member which is subsequently transferred to a copy sheet. Finally, the copy sheet is heated to permanently affix the powder image thereto in image configuration. A development system of this type is typically referred to as a two-component development system. Alternatively, single component development systems may be employed which utilize only toner particles. In many of the single component development systems, the toner particles are conductive. However, the transfer of conductive toner particles to the copy sheet is usually inefficient. In order to overcome this problem, insulating toner particles are frequently employed. These toner particles have been found to produce high quality copies.

Although various types of photoconductive members are employed, it has been found that the electrical characteristics thereof are not necessarily always repeatable. Frequently, the characteristics of the photoconductive surface vary with useage. This causes difficulty in repeating the potential on the photoconductive surface for successive cycles at the various processing stations employed within the printing machine. One method Of compensating for the variations in the electrical characteristics of the photoconductive surface is to measure the potential thereon. Heretofore, electrometers have been used to detect the characteristics of the photoconductive surface. The use of electrometers in electrophotographic printing is well known in the art. One of the major advantages of electrometers is that they provide a direct measurement of the charge actually on a specific portion of the photoconductive surface at the time the surface passes beneath the electrometer probe. The signal from the probe may then be used to control the various processing stations in the printing machine to maintain the desired relationship with respect to the potential on the photoconductive surface. Various types of electrometers have been employed to measure the electrical characteristics of the photoconductive surface. Even though the utilization of electrometers to measure the electrical characteristics of the photoconductive surface is well known, as a practical matter, the commercial utilization thereof has been hampered by the high cost, and the complexity and instability of the systems. Other techniques have been developed to determine the electrical characteristics of the photoconductive surface. The following disclosures appear to be relevant: U.S. Pat. No.: 4,194,828 Patentee: Holz et al.; Issued: May 25, 1980; IBM Technical Disclosure Bulletin; Vol. 5, No. 3A, August 1982; Printer/Copier Photoconductor Electrostatic Sensor; By: Witcher, Pages: 1092 and 1093; Co-pending U.S. application Ser. No. 490,267; Applicant: Folkins; Filed: May 24, 1984; Co-pending U.S. application Ser. No. 392,965; Applicant: Folkins; Filed: June 28, 1982.

The pertinent portions of the foregoing disclosures may be briefly summarized as follows:

Holz et al. discloses a developing electrode which includes a metal roller having a dielectric layer coated thereon. The developer electrode is coupled to an electrical circuit. In operation, the developer electrode measures the background voltage of an image free portion of the photoconductive surface and controls the development voltage in accordance with the measured background voltage.

Witcher discloses a magnetic brush development system which includes at least one developer roller which is electrically isolated so that the developer roller can be used to sense the voltage developed on the roll during operation of the electrophotographic apparatus. During the test mode, one of the developer rollers developers a voltage thereon which is proportional to the charge level on the photoconductor. This voltage is sensed and the electrostatic charge levels adjusted to maintain constant process levels throughout the life of the photoconductor.

Folkins Ser. No. 490,267 discloses a magnetic brush development system wherein developer roller is electrically biased and the current electrically biasing the developer roller is sensed. The sensed current corresponds to the electrical potential on the photoconductive surface.

Folkins Ser. No. 392,965 discloses a magnetic brush development system which operates in the developing or cleaning mode. Upon measuring the potential on the photoconductive surface, the voltage source electrically biasing the magnetic brush developer roller is disconnected therefrom, and the roller allowed to be electrically floating. The floating voltage is sensed and the inter-image region. The sensed electrical voltage corresponds to the potential on the photoconductive surface and is used to control the various processing stations within the printing machine.

Other aspects of the present invention will become apparent as the following description proceeds and upon reference to the drawing, in which.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
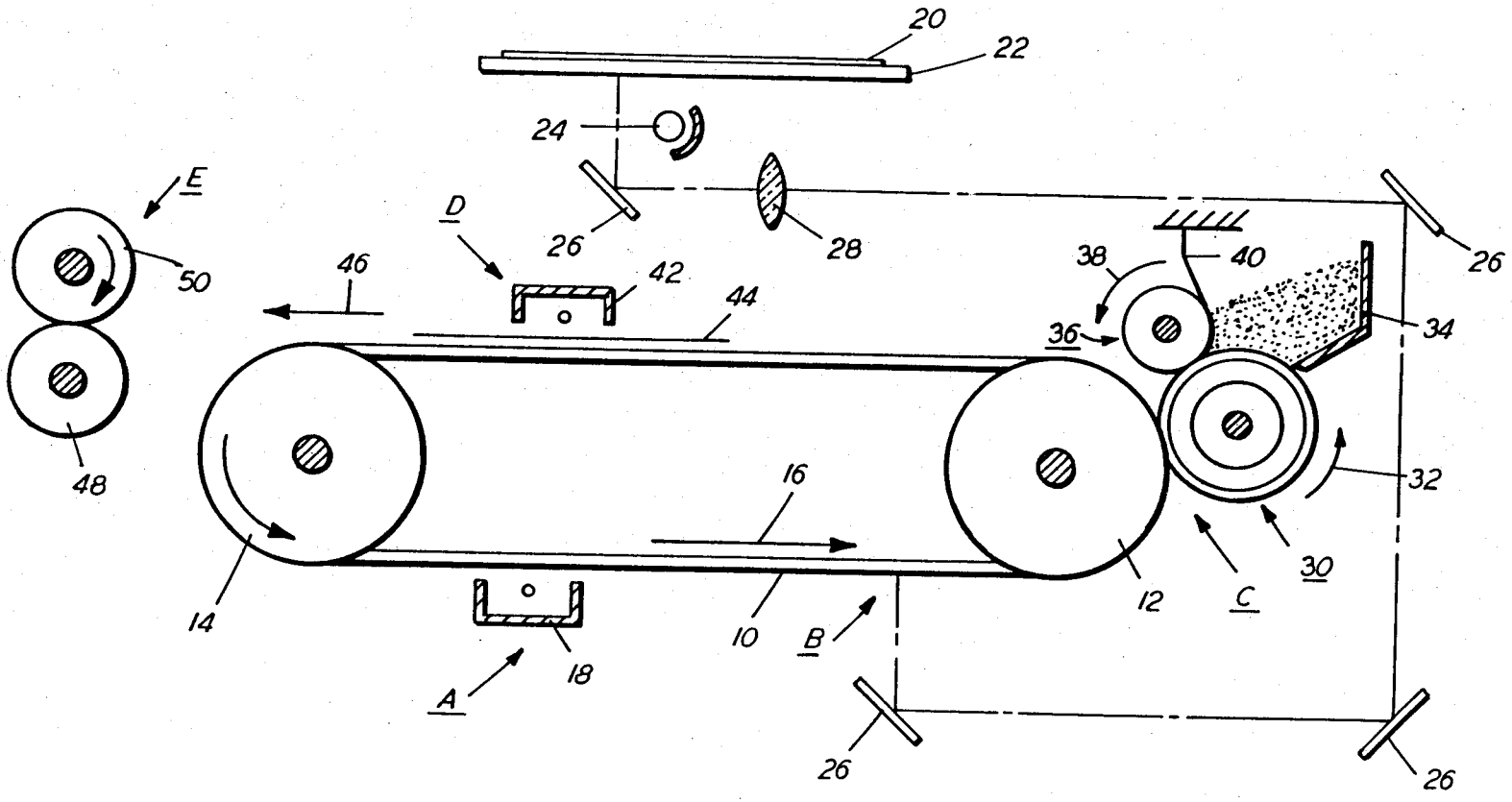
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine having the development apparatus of the present invention therein. It will become evident from the following discussion that the development apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface, e.g. a selenium alloy, deposited on a suitable conductive substrate. Other surface photoconductive materials may also be employed. Belt 10 is entrained about a pair of opposed, spaced rollers 12 and 14. Roller 14 is rotated by a motor coupled thereto by suitable means, such as a drive belt. As roller 14 rotates, belt 10 advances the photoconductive surface, in the direction of arrow 16, through the various processing stations disposed about the path of movement thereof.

Initially, the photoconductive surface passes through charging station A. At charging station A, a corona generating device charges the photoconductive surface to a relatively high, substantially uniform potential.

Next, the charged portion of the photoconductive surface is advanced through imaging station B. At imaging station B, an original document 20 is positioned face down upon a transparent platen 22. Imaging of document 20 on platen 22 is achieved by an explosive system which includes a lamp 24, mirrors 26, and a moving lens 28. The exposure system is a moving optical system wherein the lamps, mirrors and lens move across the original document illuminating incremental widths thereof. In this way, an incremental width light image is formed. The light image is projected onto the charged portion of the photoconductive surface. The charged photoconductive surface is selectively dissipated by the light image to record an electrostatic latent image of the original document thereon. Thereafter, belt 10 advances the electrostatic latent image recorded on the photoconductive surface to development station C.

At development station C, a donor roller, indicated generally by the reference numeral 30, transports weakly charged, insulating, non-magnetic toner particles into contact with the electrostatic latent image recorded on the photoconductive surface of belt 10. Donor roller 30 rotates in the direction of arrow 32. A toner particle supply reservoir 34 furnishes toner particles to donor roller 30. A metering charging roller, indicated generally by the reference numeral 36, contacts donor roller 30 to define a nip therebetween. Metering charging roller 36 rotates in the direction of arrow 38. The weakly charged toner particles on donor roller 30 pass through the nip between metering charging roller 36 and donor roller 30. As a result of the movement in opposite directions of metering charging roller 36 and donor roller 30, the toner particles of the nip acquire a charge thereon. These charged toner particles are then transported by the compliant donor roller 30 to the electrostatic latent image recorded on the photoconductive surface. The electrostatic latent image attracts the toner particles from donor roller 30 to form a powder image on the photoconductive surface of belt 10. A doctor blade 40 has the free end thereof contacting charging roller 36, doctor blade 40 acts as a seal to prevent the toner particles from advancing therebeyond. Further details of the development system will be described hereinafter with reference to FIG. 2.

With continued reference to FIG. 1, belt 10 then advances the toner powder image to transfer station D. At transfer station D, a corona generating device 42 sprays ions onto the back side of copy sheet 44 positioned thereat. This attracts the toner powder image from the photoconductive surface of belt 10 to copy sheet 44. After transfer of the toner powder image to copy sheet 44, copy sheet 44 advances, in the direction of arrow 46, through fusing station E.

Fusing station E includes a heated fuser roller 48 and a back-up roller 50 with the toner powder image on copy sheet 44 contacting fuser roller 48. In this manner, the powder image is permanently affixed to copy sheet 44. After fusing, the copy sheet is advanced by forwarding rollers through chutes to a catch tray where the operator removes the completed copy.

Figure 2:
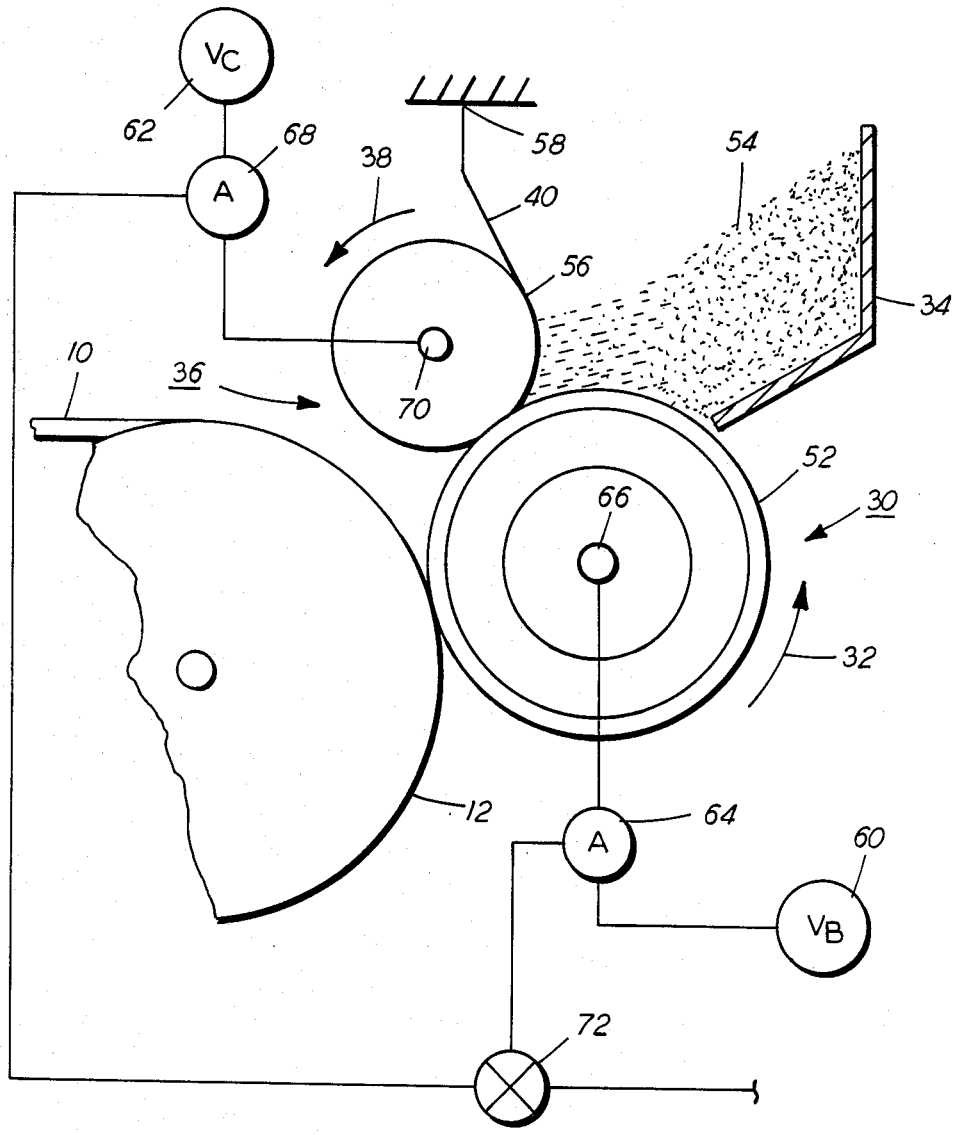
FIG. 2 is a schematic elevational view showing the development system of the FIG. 1 printing machine measuring the electrical potential on the photoconductive surface.

Referring now to FIG. 2, the detailed structure of the development apparatus is shown thereat. The development apparatus includes a compliant donor roller 30. Donor roller 30 has a fluoropolymer coating 52 thereon. Coating 52 covers the entire external circumferential surface of donor rollers 30. Generally, coating 52 has a thickness ranging from about 2 micrometers to about 125 micrometers, and preferably ranges from about 10 micrometers to about 50 micrometers. Donor roller 30 may be made from any suitable material, including, for example, aluminized Mylar, overcoated with a fluoropolymer coating, a seamless extruded polymer sleeve overcoated with a polymer containing a conductive additive such as carbon black, which are ovecoated with a fluoropolymer coating, or a bare electroformed nickel sleeve containing thereover a fluoropolymer coating processed in such a manner as to impart a texture to the surface thereof. Charging roller 36 is a metal roller which may be solid or hollow and may be made from numerous known suitable materials including, for example, aluminum, steel, iron, polymer materials, and the like, provided they are of sufficient strength to be operable in the system. Generally, roller 36 is made from aluminum. Toner supply reservoir 34 has a supply of toner particles 54 therein. Toner particles 54 in reservoir 34 are weakly charged positive and weakly charged negative particles. Doctor blade 40 has the free end thereof 56 contacting the surface of charging roller 36. In this way, as charging roller 36 rotates in the direction of arrow 38, toner particles are cleaned therefrom by doctor blade 44. The other end 58 of doctor blade 44 is mounted fixedly. Donor roller 30 is electrically biased by voltage source 60. Voltage source 60 applies a voltage $V_c$ generally ranging from about 150 volts to about 350 volts thereon. Voltage source 62 electrically biases charging roller 36 to a voltage $V_c$ which ranges from about 25 volts to about 200 volts. The detailed structure of the development apparatus is described more fully in U.S. Pat. No. 4,459,009, issued in 1984 to Hays et al., the relevant portions thereof being hereby incorporated into the present application. Current sensor 64 is electrically coupled to voltage source 60 and shaft 66 of donor roller 30. In this way, current sensor 64 detects the current electrically biasing donor roller 30. Similarly, current sensor 68 is electrically coupled to voltage source 62 and shaft 70 of charging roller 36. In this way, current sensor 68 detects the current electrically biasing charging roller 36. Current sensor 64 develops an electrical output signal indicative of the current electrically biasing donor roller 30. This electrical output signal is transmitted to summing logic circuit 72. Similarly, current sensor 68 transmits an electrical output signal indicative of the current electrically biasing charging roller 36 to summing logic circuit 72. The output from summing logic circuit 72 is a measurement of the potential on photoconductive surface 12 of drum 10 and may be utilized to control the various processing stations within the printing machine. The control scheme for regulating the various processing stations within the printing machine is shown in FIG. 3.

One skilled in the art will appreciate that voltage measurements may be made instead of current measurements. In a system of this type, current sensors 64 and 68 are not required. The input to a high impedance amplifier is connected to the input to voltage source $V_c$ and donor roller 30. A switch connects voltage source $V_b$ to voltage source $V_c$, donor roll 30, and the high impedance amplifier. When the switch is opened, voltage source $V_b$ is decoupled from voltage source $V_c$, donor roll 30 and the high impedance amplifier. In this mode of operation, the output signal from the high impedance amplifier is indicative of the sum of the potential on donor roll 30 and charging roll 36. This signal may be used to control the various processing stations in the printing machine.

In operation, it is not necessary to continuously measure the current or voltage. Periodic measurements of the current or voltage may be made and the parameters of the printing adjusted at specified time intervals. Of course, continuous measurements may be made, if desired.

Figure 3:
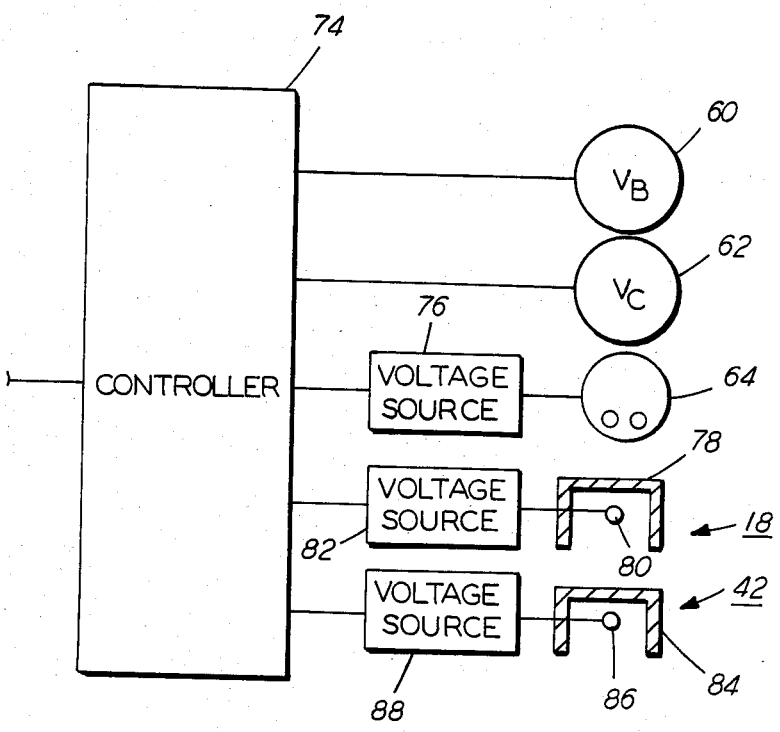
FIG. 3 is a schematic diagram showing the measured electrical potential determined in the FIG. 2 development system controlling the various processing stations within the FIG. 1 electrophotographic printing machine.

Turning now to FIG. 3, there is shown the control scheme for regulating the various processing stations within the printing machine. As shown thereat, the signal from summing logic circuit 72 is transmitted to controller 74. Controller 74 is a suitable logic circuit which may include a discriminator circuit for comparing variance references to the signal transmitted from summing logic circuit 72. The resultant error signal is utilized to regulate voltage source 60, voltage source 62, lamp 24, corona generator 18, and corona generator 42. Controller 74 compares the signal from summing logic circuit 72 with a reference corresponding to the desired voltage level for voltage source 60. The error signal is transmitted to voltage source 60 to regulate the voltage output therefrom. Similarly, the electrical signal transmitted from summing logic circuit 72 is compared with a desired reference corresponding to the desired output voltage from voltage source 62. In this way, voltage source 62 is regulated to be at the desired voltage level. The intensity of illumination of scan lamp 24 is also adjusted. Once again, the signal from summing logic circuit 72 is compared to a desired reference signal. The resultant error signal regulates the voltage output from voltage source 76. Voltage source 76 electrically energizes lamp 24. In this manner, the intensity of the light rays generated by lamp 24 is regulated as a function of the error signal. Preferably, lamp 74 is excited at a nominal value optimized for exposure. As an error signal is produced, the voltage applied to the lamp varies as a function thereof about a nominal value to compensate for deviations in the electrical characteristics of the photoconductive surface and lamp 24. The charging of the photoconductive surface by corona generating device 18 is also regulated by controller 74. An exemplary corona generating device consists of a conductive shield 78 having a corona wire 80 functioning as a discharge electrode. Voltage source 82 is connected to corona wire 80. Controller 74 compares the signal from summing logic circuit 72 to a reference. The output from controller 74 regulates the voltage applied to corona wire 80 by voltage source 82. In this manner corona wire 80 is adapted to substantially uniformly charge the photoconductive surface to the desired potential. The output from corona wire 80 is regulated to vary as a function of the signal transmitted to controller 74 by summing logic circuit 72. Thus, corona wire 80 will produce a charge sufficient to maintain the photoconductive surface at the preselected potential irrespective of variations of the electrical characteristics of the photoconductive surface. Finally, controller 74 regulates corona generating device 42 which, in turn, affects the transfer of the toner powder image from the photoconductive surface to the copy sheet. Corona generating device 42 is constructed in a substantially identical manner to that of corona generating device 18. Corona generating device 42 includes a conductive shield 84 and a corona wire 86. Corona wire 86 is electrically connected to voltage source 88 which, in turn, is connected to controller 74. Once again, controller 74 compares the signal transmitted from summing logic circuit 72 to a reference and generates an error signal to voltage source 88. This error signal controls voltage source 88. Voltage source 88, in turn, excites corona wire 86 to insure that the backside of the copy sheet is charged to a suitable level so that the toner powder image is transferred from the photoconductive surface irrespective of variations or changes in the electrical characteristics thereof.

In recapitulation, it is evident that the system of the present invention measures the electrical current biasing the donor roll and charging roll. These electrical currents are summed to produce a signal which is utilized to regulate the various processing stations within the printing machine. This signal is a function of the potential on the photoconductive surface being a measurement thereof. The signal is then utilized as a control signal to regulate the various processing stations within the printing machine.

It is, therefore, evident that there has been provided in accordance with the present invention an apparatus that fully satisfies the aims and advantages hereinbefore set forth. While this invention has been described in conjunction with various embodiments thereof, it is evident that many alternatives, modifications, and variations will be apparent to those skilled in the art. Accordingly, it is intended to embrace all such alternatives, modifications and variations as fall within the spirit and scope of the appended claims.

I claim:

1. An apparatus for measuring the electrical potential of a surface, including:

means for transporting a material closely adjacent to the surface;

means for electrically biasing said transporting means to a selected magnitude and polarity;

means for sensing the current electrically biasing said transporting means and transmitting a signal in response thereto;

means for electrically charging the material being moved to the surface by said transporting means;

means for electrically biasing said charging means to a selected magnitude and polarity;

means for detecting the current biasing said charging means and transmitting a signal in response thereto; and means for summing the signal from said sensing means with the signal from said detecting means and transmitting a signal in response thereto indicative of the electrical potential of the surface.

2. An apparatus according to claim 1, further including means, responsive to the signal from said summing means, for controlling said means for electrically biasing said transporting means.

3. An apparatus according to claim 1, further including means, responsive to the signal from said summing means, for controlling said means for electrically biasing said charging means.

4. An apparatus according to claim 1, wherein said charging means includes a charging roller.

5. An apparatus according to claim 4, wherein said transporting means includes a donor roller positioned in contact with said charging roller to define a nip therebetween with the material being charged in the nip.

6. An apparatus according to claim 5, wherein said charging roller meters the quantity of material being moved by said donor roller to the surface.

7. An electrophotographic printing machine of the type having an electrostatic latent image recorded on a photoconductive surface with the latent image being developed with toner particles to form a toner powder image thereon that is transferred to a copy sheet and substantially permanently fused thereto, wherein the improvement includes:

means for transporting the toner particles closely adjacent to the photoconductive surface;

means for electrically biasing said transporting means to a selected magnitude and polarity;

means for sensing the current electrically biasing said transporting means and transmitting a signal in response thereto;

means for electrically charging the toner particles being moved to the photoconductive surface by said transporting means;

means for electrically biasing said charging means to a selected magnitude and polarity;

means for detecting the current biasing said charging means and transmitting a signal in response thereto; and means for summing the signal from said said sensing means with the signal from said detecting means and transmitting a signal in response thereto indicative of the electrical potential of the surface.

8. A printing machine according to claim 7, further including means, responsive to the signal from said summing means, for controlling said means for electrically biasing said transporting means.

9. A printing machine according to claim 7, further including means, responsive to the signal from said summing means, for controlling said means for electrically biasing said charging means.

10. A printing machine according to claim 7, wherein said charging means includes a charging roller.

11. A printing machine according to claim 10, wherein said transporting means includes a donor roller positioned in contact with said charging roller to define a nip therebetween with the toner particles being charged in the nip.

12. A printing machine according to claim 11, wherein said charging roller meters the quantity of toner particles being moved by said donor roller to the photoconductive surface.

13. An apparatus for measuring the electrical potential of a surface, including:

means for transporting a material closely adjacent to the surface;

means for electrically biasing said transporting means;

means for electrically charging the material being moved to the surface by said transporting means;

means, coupled to said transporting electrical biasing means, for electrically biasing said charging means;

means for coupling and decoupling said transporting electrical biasing means from said transporting means and said charging electrical biasing means; and means for generating a control signal proportional to the sum of the potential of said transporting means and said charging means in response to said coupling and decoupling means decoupling said transporting electrical biasing means from said transporting means and said charging electrical biasing means.

14. An electrophotographic printing machine of the type having an electrostatic latent image recorded on a photoconductive surface with the latent image being developed with toner particles to form a toner powder image thereon that is transferred to a copy sheet and substantially permanently fused thereto, wherein the improvement includes:

means for transporting a material closely adjacent to the photoconductive surface;

means for electrically biasing said transporting means;

means for electrically charging the material being moved to the surface by said transporting means;

means, coupled to said transporting electrical biasing means, for electrically biasing said charging means;

means for coupling and decoupling said transporting electrical biasing means from said transporting means and said charging electrical biasing means; and means for generating a control signal proportional to the sum of the potential of said transporting means and said charging means in response to said coupling and decoupling means, decoupling said transporting electrical biasing means from said transporting means and said charging electrical biasing means.

* * * * *